United States Patent [19]

Bruderreck et al.

[11] Patent Number: 4,468,233

[45] Date of Patent: Aug. 28, 1984

[54] MOTOR FUEL CONTAINING TERT-BUTYL ETHERS

[75] Inventors: Hartmut Bruderreck, Gelsenkirchen-Buer; Günter Deininger, Dorsten; Klaus Gottlieb, Herdecke-Ende; Friedel-Heinrich Wehmeier, Bottrop-Kirchhellen; Manfred Haselhorst, Dorsten, all of Fed. Rep. of Germany

[73] Assignee: Veba Oel AG, Gelsenkirchen-Buer, Fed. Rep. of Germany

[21] Appl. No.: 372,801

[22] Filed: Apr. 28, 1982

[30] Foreign Application Priority Data

Apr. 28, 1981 [DE] Fed. Rep. of Germany ..... 3116734

[51] Int. Cl.[3] ..... C10L 1/18

[52] U.S. Cl. ..... 44/56

[58] Field of Search ..... 44/56

[56] References Cited

U.S. PATENT DOCUMENTS

| | | | |
|---|---|---|---|
| 2,132,017 | 10/1938 | Evans | 44/56 |
| 2,897,067 | 7/1959 | Sparks et al. | 44/56 |
| 2,952,612 | 9/1960 | Trainer | 208/67 |
| 3,849,082 | 11/1974 | Kozlowski et al. | 44/56 |
| 3,904,384 | 9/1975 | Kemp et al. | 44/56 |
| 4,046,520 | 9/1977 | Kemp et al. | 44/56 |
| 4,255,158 | 3/1981 | King | 44/56 |

FOREIGN PATENT DOCUMENTS

| | | |
|---|---|---|
| 791258 | 6/1935 | France . |
| 828020 | 10/1937 | France . |
| 829581 | 11/1937 | France . |
| 1461966 | 1/1977 | United Kingdom . |

*Primary Examiner*—Y. Harris-Smith

*Attorney, Agent, or Firm*—Oblon, Fisher, Spivak, McClelland & Maier

[57] ABSTRACT

A motor fuel comprising 35–98% hydrocarbon-containing base and 2–65% by volume of an additive which comprises a mixture containing (a) 5–35% by volume of methyl tert-butyl ether;

(b) 5–40% by volume of isopropyl tert-butyl ether; and (c) 5–40% by volume of sec-butyl tert-butyl ether, has a high octane number and reduces exhaust pollutants.

6 Claims, No Drawings

MOTOR FUEL CONTAINING TERT-BUTYL ETHERS

BACKGROUND OF THE INVENTION

1. Field of the Invention

This invention relates to valuable motor fuels which are characterized by high octane numbers, and reduced content of hydrocarbons, carbon monoxide and especially nitrogen oxides in the exhaust gases of an internal combustion engine using spark ignition. The fuels according to the invention attain octane numbers which make it possible to omit entirely any lead-containing additive.

The fuels of the invention are further characterized by a lower cloud point, increased oxidation stability and decreased specific energy consumption.

2. Description of the Prior Art

In order to increase the efficiency of the engine, which results in a lowering of the specific fuel consumption, the compression ratio is especially important. The resulting tendency of the engine to knock must be compensated by increasing the octane number of the fuel. For this purpose, anti-knock agents, particularly lead alkyls, alkylates or aromatics are added. Unfortunately, this causes an associated serious deterioration in the quality of the exhaust emissions. Besides poisonous combustion products of the lead compounds, an increase in the nitrogen oxide content is observed, due to high combustion chamber temperatures. If the lead content is decreased, the octane number can be adjusted by increased addition of aromatics. In place of a portion of the aromatics, octane-increasing isoparaffins, which are found in relatively large amounts in alkylate may be added.

However, a reduction in the pollutants, especially of nitrogen oxides, is not achieved by this expedient.

It is also known that the octane number can be increased and the exhaust gas pollution can be decreased by addition of methanol. However, in order to operate an internal combustion engine having spark ignition with a motor fuel containing more than 5% by volume of methanol, vehicles having such engines have to be equipped with methanol-resistant sealing materials. A further serious disadvantage of admixing more than 5% by volume of methanol is that in dual-fuel operation with a methanol-hydrocarbon mixture and a pure hydrocarbon mixture using conventional carburetors and injectors, the air-fuel ratio has to be adjusted so that the proportion of pollutants is kept within the exhaust limits for operation on pure hydrocarbons. An internal combustion engine with spark ignition which is adjusted to this fuel-air ratio can then no longer attain its maximum possible power output when operated on a methanol fuel containing more than 5% methanol by volume.

It is also known to add methyl tert-butyl ether or methyl tert-amyl ether to the fuel. It is a disadvantage that these constituents cannot be added by themselves in arbitrarily large proportions, since then DIN 51 600 and the other internationally prescribed standards of volatility for engine equipped with carburetors can no longer be met.

SUMMARY OF THE INVENTION

The present invention substantially overcomes the above-mentioned problems and disadvantages and makes possible new technical solutions. It is therefore, an object of the present invention to provide a combination of materials for the manufacture of leaded or unleaded motor fuels for internal combustion engines having spark ignition which is suitable for reducing the specific energy consumption.

It is a further object of the present invention to reduce fuel consumption.

It is yet another object to provide a motor fuel having high octane number as well as improved quality of the exhaust gas.

These and other objects are attained by the present invention by a motor fuel comprising 35–98% hydrocarbon-containing base and 2–65%, preferably 10–30% by volume of an ether mixture. The hydrocarbon-containing base can be, e.g., any hydrocarbon mixture occurring during refining, even a mixture containing oxygen compounds with suitable boiling properties. A specially suitable base component is a hydrocarbon-containing mixture which cannot be adjusted to a motor fuel which meets specifications either by itself or by addition of ingredients other than the ether mixture of the invention, e.g., straightrun gasoline.

DETAILED DESCRIPTION OF THE PREFERRED EMBODIMENTS

The ether mixture contains several fuel quality enhancing ingredients from the group of methyl tert-butyl ether, isopropyl tert-butyl ether and sec-butyl tert-butyl ether. The proportions are defined within certain limits of the basic components. For methyl tert-butyl ether 5–35% by volume of the total ether additive is preferred; for isopropyl tert-butyl ether and sec-butyl tert-butyl ether about 5–40% by volume of the total ether additive is preferred. Especially advantageous are additives in which the volume ratio of methyl tert-butyl ether to isopropyl tert-butyl ether to sec-butyl tert-butyl ether is about 1:1:1.

When the motor fuel contains the additives of the invention the improvement in the octane number and the decrease in hydrocarbons and nitrogen oxides in the exhaust is observed to be independent of the composition of the hydrocarbon fraction used as the base component. Furthermore, the motor fuels of this composition can also contain additives such as alcohols, e.g., ethyl alcohol, and/or lead alkyls. In particular, according to the invention, tert-butanol, sec-butanol, isopropanol and methanol are used in addition to the ether mixture. The additive mixture can contain up to 50% by volume of the enumerated alcohols. When alcohols are used, the proportion of methanol should not exceed 15% by volume of the ether-alcohol additive and the proportion of isopropanol, sec-butanol, each should not exceed 20% by volume, the proportion of tert-butanol should not exceed 50% by volume. The preferred volume ratios of isopropanol to isopropyl tert-butyl ether are 1:4 to 1:10 and of sec-butanol to sec-butyl tert-butyl ether 1:5 to 1:20.

The fuel additives of the invention produce a generally better controlled burning of the fuel, whereby greater economy and higher power are attained, as well as a lower content of pollutants in the exhaust. An especial advantage is that the lead compounds which have hitherto been added for controlling the combustion can be omitted. By the use of the ether or ether-alcohol mixtures of the invention, a uniform distribution of the oxygen-containing components over the entire boiling range of the fuel is achieved, whereby these advantages are assured for all operating modes of the engine, such as starting, acceleration, idling, etc. Furthermore, overheating conditions, which can cause material damage in the combustion chamber, are not only prevented by these components, but a noticeable decrease in temperature occurs as compared with operation with conventional motor fuels.

While the component used hitherto, i.e., methyl tert-butyl ether, increases the octane number only to a limited extent in the absence of lead compounds, the ether or ether-alcohol mixtures of this invention produce an improvement in the octane number which increases steadily with increasing concentration, even when no lead compounds have been added. The magnitude of the octane number increase which can be attained and the relative decrease in the proportion of pollutants in the exhaust can be seen from the comparative experiments.

According to the invention a carburetor motor fuel can be prepared having an octane number high enough that engines can be operated at compression ratios which clearly exceed those of currently mass-produced engines. At compression ratios of, e.g., 12:1 to 14:1 the specific fuel consumption is significantly reduced and, accordingly, also the absolute amounts of exhaust and pollutants.

An additional beneficial result regarding the decrease in exhaust is that the carburetor motor fuels of the invention can be prepared lead-free. Accordingly, the conventional procedures for catalytic post-combustion of the exhaust gases can be used with improved economy. It is well-known that the available post-combustion catalysts are deactivated by lead and therefore are short-lived, and thus uneconomic, when leaded fuels are used.

The use of ether or ether-alcohol mixtures is an improvement over the use of a single ether, especially over the use of methyl tert-butyl ether alone, particularly when lead-free fuels are used as contemplated in this invention. As the comparative experiments demonstrate, the attainable relative improvement in octane number, expressed as the blending value, e.g., the motor octane number, decreases with increasing concentration when methyl tert-butyl ether alone is added. When only isopropyl tert-butyl ether and/or sec-butyl tert-butyl ether are added the relative octane number improvement, also expressed as the blending values, increases with increasing concentration. When the ether-alcohol mixtures of the invention are used, the attainable octane number improvement steadily increases with the amount added to the basic component.

Furthermore, the addition of large amounts of a single ether adversely affects the vaporization properties. Thus, the portion vaporizing at low temperatures is increased to an unacceptable degree by addition of methyl tert-butyl ether alone. This can lead to difficulties in conventional carburetor-equipped engines. On the contrary, when the mixture of the invention is added, the octane number of the gasoline is increased and the pollutants in the exhaust are decreased, without incurring such difficulties. The reason for this is found in the improved vaporization properties of the mixture according to the invention. The distillation curve of the ether-alcohol mixture covers a wide range (55°–115° C.). This is especially important for carburetor motor fuels which are used in summer or in countries having a constant high ambient temperature.

A feature of the fuel of the invention which is important for storage is that the addition of ether or ether-alcohol mixtures increases the oxidation stability of the fuel.

The fuel of the invention is not corrosive towards the metallic materials, plastic parts and sealing materials used in fuel tanks, engines, etc. A further advantage is an improved behavior with regard to water uptake and improved solvent properties as compared with other oxygen-containing components such as ethanol and methanol. This results in reduced danger of phase separation, provoked by small amounts of water, and the cloud points are very low.

The fuels of the invention exhibit very good driveability. They permit advanced ignition timing as compared with fuels currently on the market. Accordingly, higher road octane numbers are attainable as compared with available fuels.

The preferred embodiments of the present invention will now be illustrated by examples without limiting the scope thereof.

EXAMPLES

An ether mixture:

1.

33.3% by volume methyl tert-butyl ether
33.3% by volume isopropyl tert-butyl ether
33.3% by volume sec-butyl tert-butyl ether and an ether-alcohol mixture:

2.

28.3% by vol. methyl tert-butyl ether
28.3% by vol. isopropyl tert-butyl ether
28.3% by vol. sec-butyl tert-butyl ether
5% by vol. methanol
5% by vol. isopropanol
5% by vol. sec-butanol were prepared by mixing the components. These mixtures are designated B1 and B2 in presenting the results of the following comparative experiments.

COMPARATIVE EXPERIMENTS

Five, 10, and 20 parts by volume of each of the individual ethers used in the invention, methyl tert-butyl ether (MTB), isopropyl tert-butyl ether (PTB) and sec-butyl tert-butyl ether (BTB) were mixed with 95, 90 and 80 parts by volume of a basic motor fuel component (BC1). The basic component was a hydrocarbon mixture obtained in petroleum refining, which was used in preparing premium fuel and had, when unleaded, a motor octane number (MON) of 84 and a research octane number (RON) of 93.

The MON of the individual mixtures was determined using a CFR test engine. In each case measurements were made unleaded and with 0.15 g per liter of added lead (+Pb). From these measurements, assuming a linear relation for the MON, both the MON of the basic component and the MON of the pure ether (blending values) were calculated. The results in Table 1 for unleaded fuels show a great decrease in the MON blending values of the methyl tert-butyl ether with increasing proportion, while the MON blending values for isopropyl tert-butyl ether and sec-butyl tert-butyl ether increase.

TABLE 1

| Fuel | Blending Values-MON | Blending Values-MON +Pb |
|---|---|---|
| 95 BC1 + 5 MTB | 104 | 103 |
| 90 BC1 + 10 MTB | 100 | 103 |
| 80 BC1 + 20 MTB | 99 | 103 |
| 95 BC1 + 5 PTB | 100 | 108 |
| 90 BC1 + 10 PTB | 104 | 111 |
| 80 BC1 + 20 PTB | 105 | 112 |
| 95 BC1 + 5 BTB | 92 | 106 |
| 90 BC1 + 10 BTB | 94 | 105 |
| 80 BC1 + 20 BTB | 97 | 104 |

Similarly, mixtures of 95, 90, 80 and 50 parts by volume of a similar basic fuel component (BC2), which had an MON of 84.5 and an RON of 95, and 5, 10, 20 and 50 parts by volume of the ether alcohol mixture of Example 2 were prepared, the MON and RON of the unleaded mixtures were measured and the blending values of the additives were calculated. The results are presented in Table 2.

TABLE 2

| Fuel | Blending Values-MON | Blending Values-RON |
|---|---|---|
| 95 BC2 + 5 B2 | 95 | 111 |
| 90 BC2 + 10 B2 | 98 | 113 |
| 80 BC2 + 20 B2 | 99 | 114 |
| 50 BC2 + 50 B2 | 100 | 116 |

The improvement in the octane numbers of both commercial premium gasoline (PG), measured according to DIN 51 600, leaded with 0.15 g per liter, and the above-described unleaded basic component (BC2), produced by the additives of the invention are given in Table 3.

TABLE 3

| Fuel | MON | RON |
|---|---|---|
| 100 PG | 88.2 | 98.2 |
| 90 PG + 10 B1 | 90.0 | 99.9 |
| 80 PG + 20 B1 | 91.8 | 102.0 |
| 80 PG + 20 B2 | 91.4 | 101.8 |
| 100 BC2 | 84.5 | 95.0 |
| 95 BC2 + 5 B2 | 85.0 | 95.8 |

TABLE 3-continued

| Fuel | MON | RON |
|---|---|---|
| 90 BC2 + 10 B2 | 85.8 | 96.8 |
| 80 BC2 + 20 B2 | 87.3 | 98.8 |
| 50 BC2 + 50 B2 | 92.0 | 105.5 |

Table 4 shows that it is possible to meet the specifications of DIN 51 600 (column 1) simply by using the additives of the invention, both for leaded (column 2) and especially for unleaded (column 3) mixtures. On the other hand this is not possible by adding methyl tert-butyl ether alone (column 5), e.g., to a straightrun gasoline with added butane (Bu); however, it is possible, by addition of the mixtures of the invention (column 4) to prepare a premium fuel meeting the specifications of DIN 51 600 from such a base material.

TABLE 4

| Properties | DIN 51 600 | 80.5 PC1 + 19.5 B2 + Pb | 75.2 BC1 + 24.8 B2 | 40.5 SR + 54 B2 + 5.5 Bu + Pb | 43.5 SR + 51.5 MTB + 5.0 Bu + Pb |
|---|---|---|---|---|---|
| Density at 15° C., g/ml | 0.735–0.780 | 0.740 | 0.755 | 0.735 | 0.733 |
| Vapor pressure (RVP), bar | Summer: 0.6–0.9 Winter: 0.45–0.7 | 0.66 | 0.71 | 0.66 | 0.65 |
| RON | 98 | 99.6 | 99.8 | 98.6 | 98.6 |
| MON | 88 | 88.0 | 88.0 | 92.6 | 92.6 |
| Vaporizable portion at: | | | | | |
| 70° C., Vol. % | Summer: 15–40 Winter: 20–45 | 38 | 37.5 | 27 | 59.5 |
| 100° C., Vol. % | Summer: 42–65 Winter: 45–70 | 63 | 54 | 63 | 77.5 |
| 180° C., Vol. % | 90 | 97 | 95.5 | 99 | 99 |
| Water content g/l | — | 0.8 | 1 | 1.1 | 0.14 |

In order to measure the pollutants in the exhaust, a 2.0 l injected engine, compression ratio 9.4:1 (manufactured by Opel) was operated with commercial premium fuel as per DIN 51 600, leaded with 0.15 g per liter, and also with a straight run gasoline-ether-alcohol mixture according to the invention. In order to have comparable measurements, the amount of carbon monoxide in the exhaust was adjusted each time to 2.0% by volume. The individual exhaust proportions and the specific consumption are tabulated in Table 5.

TABLE 5

| | PG | | 40.5 Sr + 54.0 B2 + 5.5 Bu + PB2 | |
|---|---|---|---|---|
| Measured quantity | 2000 RPM | 5000 RPM | 2000 RPM | 5000 RPM |
| Carbon monoxide, Vol. % | 2.0 | 2.0 | 2.0 | 2.0 |
| Carbon dioxide, Vol. % | 13.7 | 14.2 | 13.05 | 13.4 |
| Hydrocarbons, ppm | 1200 | 530 | 810 | 340 |
| Nitrogen oxides, ppm | 2290 | 3550 | 1810 | 2640 |
| Specific energy, consumption, | 12.75 | 12.88 | 12.45 | 12.67 |

The beneficial motor properties of the fuels of this invention can be seen from the following comparative experiment: In a 1.2 l engine having a compression ratio of 9:1 (Opel Kadett), adjusting the carbon monoxide content of the exhaust to 2.0% by volume in each case, the spark advance at which knocking begins at full throttle was determined both for operation of the engine with commercial premium fuel according to DIN 51 600, leaded with 0.15 g per liter, and with leaded and unleaded fuels according to the invention. In Table 6 the differences in ignition advance relative to operation with commercial premium fuel are given in degrees of crankshaft revolution (°CR).

TABLE 6

| Rotation speed | Difference in ignition point in ° of crankshaft revolution compared with PG | |
|---|---|---|
| R/min | 80.5 BC1 + 19.5 B2 + Pb | 75.2 BC1 + 24.8 B2 |
| 2000 | +4.5 | +3.5 |
| 3000 | +3.5 | +1.0 |
| 4000 | +1.5 | +1.0 |

To determine the oxidation stabilization produced by the added ether of the invention, the induction time by DIN 51 780 was determined for commercial premium fuel alone and in mixture with 20% by volume of methyl tert-butyl ether, of isopropyl tert-butyl ether, and of sec-butyl tert-butyl ether. The results are presented in Table 7.

TABLE 7

| Fuel | Induction time, minutes |
|---|---|
| 100 PG | 465 |
| 80 PG + 20 MTB | 470 |
| 80 PG + 20 PTB | 570 |
| 80 PG + 20 BTB | 525 |

It is understood that various changes and modifications in light hereof will be apparent to those skilled in the art and are included within the purview of this invention.

What is claimed as new and desired to be secured by Letter Patent of the United States is:

1. A motor fuel containing tert-butyl ethers comprising 70–95% by volume of hydrocarbon-containing base and 5–30% by volume of an additive which comprises a mixture which contains 5–35% by volume of methyl-tert-butyl ether, 5–40% by volume of isopropyl tert-butyl ether and 5–40% by volume of sect-butyl tert-butyl ether.

2. The motor fuel of claim 1, wherein said additive comprises 10–30% by volume of said fuel.

3. The motor fuel of claim 1 wherein said additive contains methyl tert-butyl ether, isopropyl tert-butyl ether, and sec-butyl tert-butyl ether in a volume ratio of about 1:1:1.

4. The motor fuel of claim 1 wherein said additive additionally comprises at least one alcohol selected from the group consisting of 1–25% by volume of tert-butanol, 1–10% by volume of sec-butanol, 1–10% by volume of isopropanol and wherein the total proportion of said alcohols does not exceed 50% by volume, preferably up to 25%, of said additive.

5. The motor fuel of claim 4, wherein said additive comprises isopropyl tert-butyl ether and isopropanol in a volume ratio of 4:1 to 10:1.

6. The motor fuel of claim 4, wherein said additive comprises sec-butyl tert-butyl ether and sec-butanol in a volume ratio of 5:1 to 20:1.

* * * * *

UNITED STATES PATENT AND TRADEMARK OFFICE

CERTIFICATE OF CORRECTION

PATENT NO. : 4,468,233

DATED : August 28, 1984

INVENTOR(S) : Hartmut Bruderreck et al

It is certified that error appears in the above-identified patent and that said Letters Patent is hereby corrected as shown below:

On page one, under the heading "Inventors:", insert --; August-Wilhelm Preuss, Dorsten-- after "Manfred Haselhorst, Dorsten".

Signed and Sealed this

*Tenth* Day of *December 1985*

[SEAL]

*Attest:*

DONALD J. QUIGG

*Attesting Officer*

*Commissioner of Patents and Trademarks*